United States Patent [19]

Marega

[11] Patent Number: 4,920,666

[45] Date of Patent: May 1, 1990

[54] DYNAMIC INNER LINING SHOE FOR BOOTS

[75] Inventor: Antonello Marega, Nervesa della Battaglia Treviso, Italy

[73] Assignee: Calzaturificio Tecnica Spa, Treviso, Italy

[21] Appl. No.: 269,415

[22] Filed: Nov. 10, 1988

[30] Foreign Application Priority Data

Nov. 26, 1987 [IT] Italy ..... 22762 A/87

[51] Int. Cl.[5] ..... A43B 5/04; A43B 19/00; A43B 23/26

[52] U.S. Cl. ..... 36/119; 36/10; 36/54

[58] Field of Search ..... 36/117–121, 36/10, 93, 71, 54, 59 C, 55; 2/239

[56] References Cited

U.S. PATENT DOCUMENTS

| | | | |
|---|---|---|---|
| 793,095 | 6/1905 | Rapp | 36/54 |
| 954,413 | 4/1910 | Bailey | 36/59 C |
| 4,154,009 | 5/1979 | Kubelka et al. | 36/119 |
| 4,406,073 | 9/1983 | Spademan | 36/119 |
| 4,499,675 | 2/1985 | Perotto | 36/119 |
| 4,534,122 | 8/1985 | MacPhail | 36/119 X |
| 4,723,364 | 2/1988 | Marker | 36/10 |

FOREIGN PATENT DOCUMENTS

| | | | |
|---|---|---|---|
| 3429284 | 2/1986 | Fed. Rep. of Germany | 36/119 |
| 2230155 | 12/1974 | France | 36/119 |
| 626793 | 12/1981 | Switzerland | 36/117 |
| 654467 | 2/1986 | Switzerland | 36/10 |

*Primary Examiner*—James Kee Chi

*Attorney, Agent, or Firm*—Armstrong, Nikaido, Marmelstein, Kubovcik & Murray

[57] ABSTRACT

In the inner lining shoe for boots, particularly ski boots, an fore tongue is anchored in a floating manner to the upper, so as to be displaceable in a controlled manner with respect to the upper under the action of elastic return means. Elastically deformable means are also provided to prevent the deformation of the upper under stress, while permitting the bending of the leg portion with respect to the true upper.

11 Claims, 4 Drawing Sheets

DYNAMIC INNER LINING SHOE FOR BOOTS

The present invention relates to an inner lining shoe for boots, particularly ski boots, to which specific reference shall be made in the following specification. This invention is not limited however to use only in ski boots.

It is known that ski boots normally comprise an outer rigid casing, the sole of which is anchored to the ski, an inner sole and an inner lining shoe by which the foot is fully enveloped preventing any direct contact of the foot, the ankle and the lower part of the leg with the outer rigid casing.

Such a lining shoe is normally provided with a big fore tongue, movable with respect to the remaining shoe, to permit the foot introduction, in the same manner of the fore tongue of the normal footwear.

It is also clear that such a shoe must form a wrapping around the foot and be in close contact with outer casing since it is the direct transmission means of the controls to be given to the ski starting from the foot of the skier. To date to fulfill these requirements other features have been sacrificed such as:

- the fitting comfort of the lining shoe which remains rather rigid;
- the fitting capability of the lining shoe to the several positions of closure of the outer casing (it is to be mentioned that also the outer casing in most of the cases comprises a leg portion divided in two halves which are openable wide a part and which are brought towards each other and fixed by means of suitable adjustable straps).
- the capability of the lining shoe of following the movements of the casing.

Otherwise stated, to date, the inner lining shoe was an essentially static and rather rigid envelope adapted to envelope the foot mainly satisfying the requirements of rigidly adhering to the casing while sacrificing more comfortable fit.

The main object of the present invention is that of providing an inner lining shoe for boots permitting:

(a) a greater articulation for better following the movements of the rigid casing.

(b) a better, more elastic fit avoiding the deformations which are characteristics of rigid shoes, when the boot, and consequently also the shoe, is under stress.

(c) the elimination of localized pressures on critical areas of the foot when the outer casing is tightened on the shoe, such as for instance the pressure acting on the adducting tendon of the big toe.

(d) a greater adherence of the shoe to the inner sole of the casing whereby preserving the freedom of movement of the shoe.

It has been now found, and is the object of the present invention, that the above purposes are achieved by means of an inner lining shoe for boots, of the type comprising a sole, a forwardly open upper and provided with a fore tongue, said upper being completed from a leg portion, characterized in that said tongue is anchored in a floating manner to the upper, namely with the possibility of a relative sliding with respect to the upper, and that, at the junction of said leg portion to said upper, at least one elastic insert is provided permitting the articulation of the leg portion without deformation of the upper and without undue constriction or pressure on the malleolus.

In a preferred embodiment of the lining shoe of the present invention, said tongue is displaceably anchored to the upper, by means of the elastic return, towards the normal or resting position, and moreover a relief undercutting is formed (in the tongue) corresponding to the path of the adducting tendon of the big toe to prevent any undue localized pressure.

According to a further feature of the lining shoe of the present invention, the connection of the sole to the upper of the lining shoe is formed by means of a box like sewed structure in order to eliminate objectionable dead spaces between the shoe and the inner adjacent surface of the casing.

Furthermore, the sole of the lining shoe is engraved according to a pattern which prevents sliding of the shoe with respect to the underlying inner sole of the casing.

Lastly, according to a further feature of the present invention, the sole of the lining shoe is provided with a hollow at the metatarsal area of the foot permitting the introduction of an insert adapted to finely adjust of the fitting of the foot into the lining shoe.

The above and other features of the present invention shall appear from the following detailed description of a preferred embodiment, which is exemplary but not limiting on the scope of the invention, with reference to the accompanying drawings, wherein.

Figure 1:
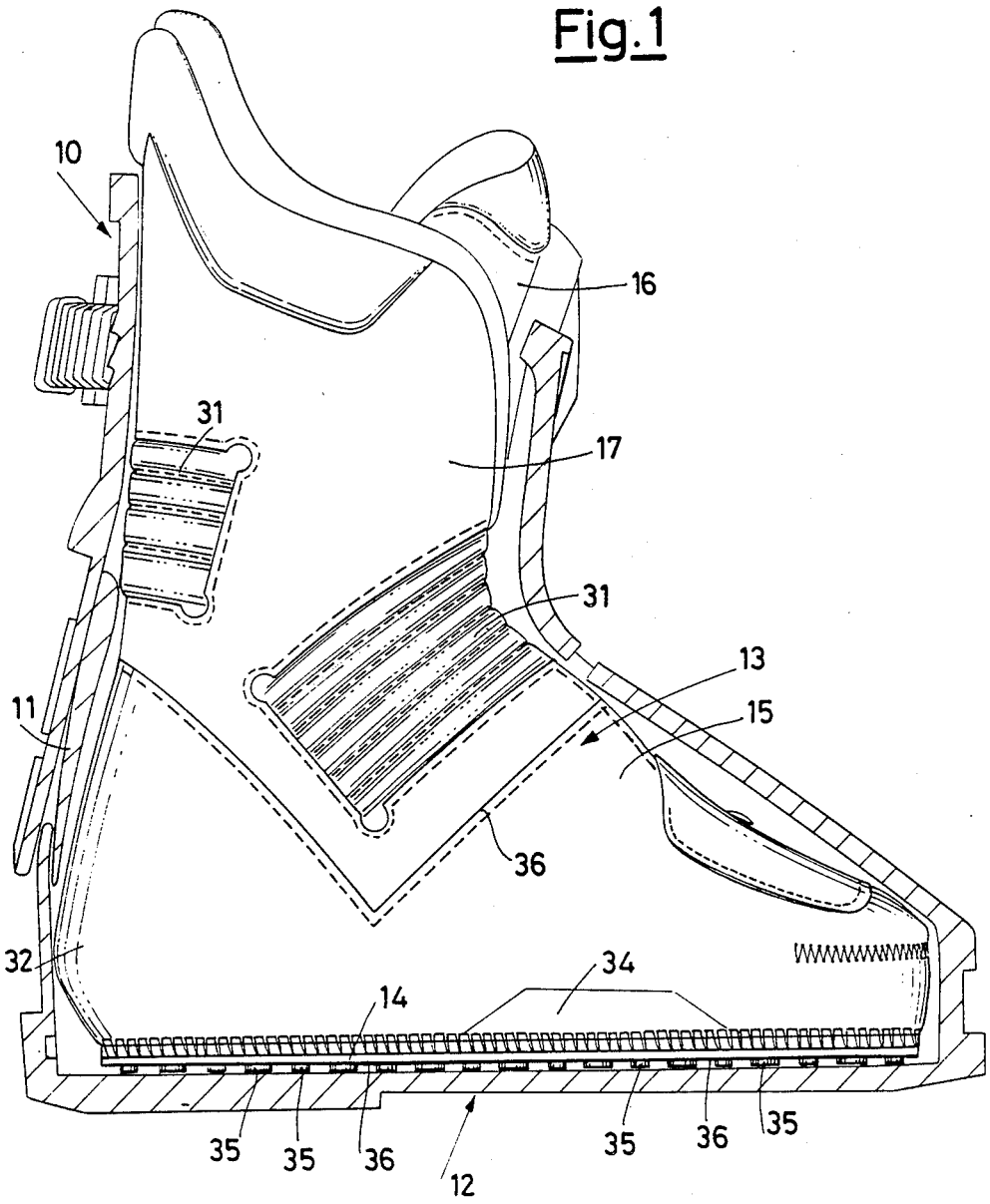
FIG. 1 is a longitudinal cross-section side view of a ski boot including a lining shoe according to the invention.

Referring firstly to FIG. 1, a ski boot 10 is shown comprising an outer rigid casing 11, a sole 12, and an inner lining shoe 13.

FIG. 1 is simplified as regard the structure of the boot, which normally comprises a leg portion vertically divided so as to permit the introduction of the foot and pivotally joined to the upper of the boot to permit the desired and adjustable inclination of the leg with respect to the foot and consequently with respect to the ski to which to boot is secured.

Likewise the sole 12 normally comprises an inner sole, which usually can be removed and is the abutting portion for the lining shoe 13. Turning now to the lining shoe 13, being the object of the present invention, it comprises a sole 14, an upper 15, a tongue 16 and a leg portion 17.

Figure 2:
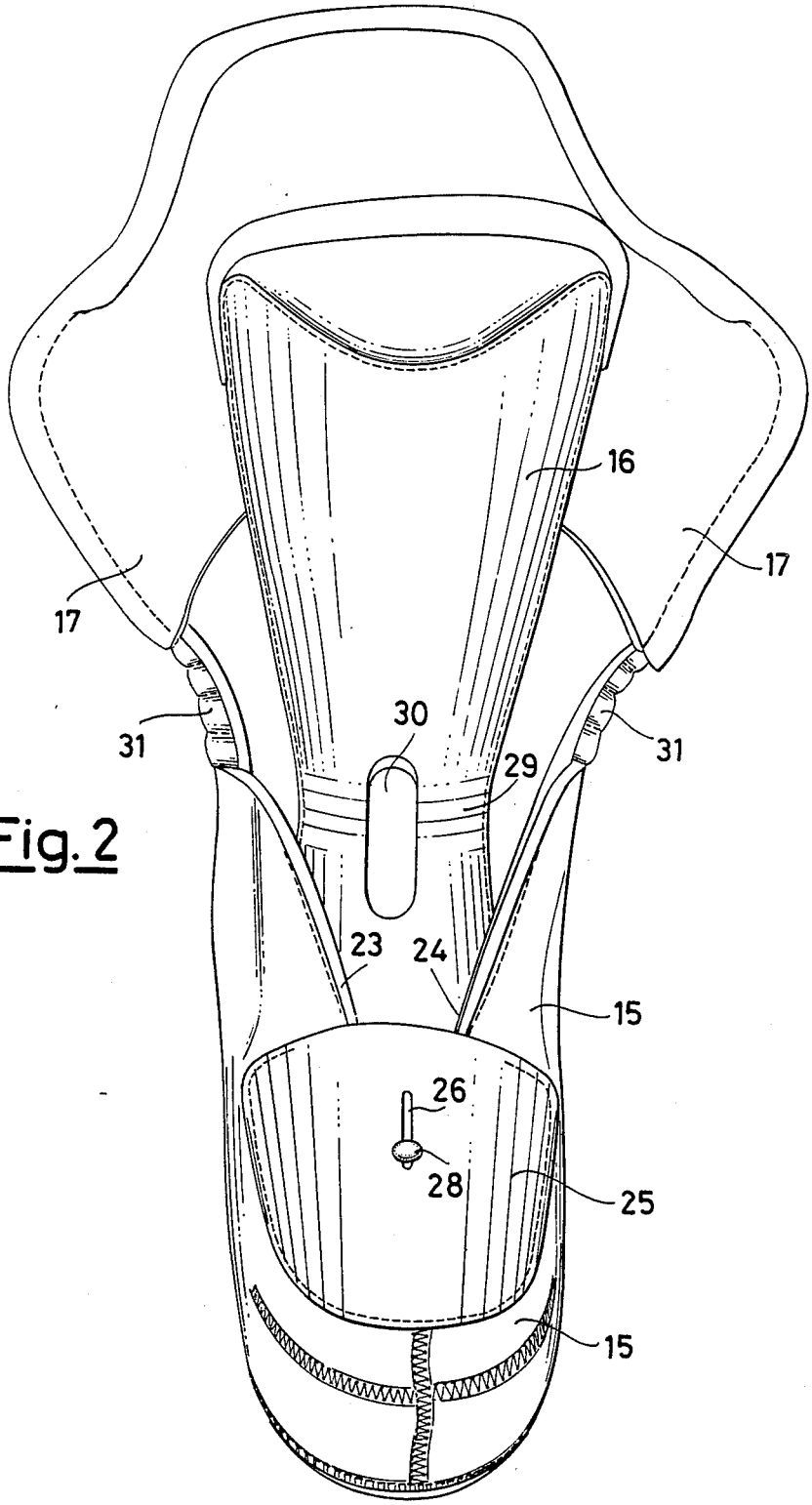
FIG. 2 is a front view, partially from above, of the lining shoe only.

As it is clearly seen in FIG. 2, the tongue 16 is positioned at the fore opening of the upper 15 and of the leg portion, closing the same opening when the leg portion of the casing is closed and tightened around the lining shoe.

Figure 4:
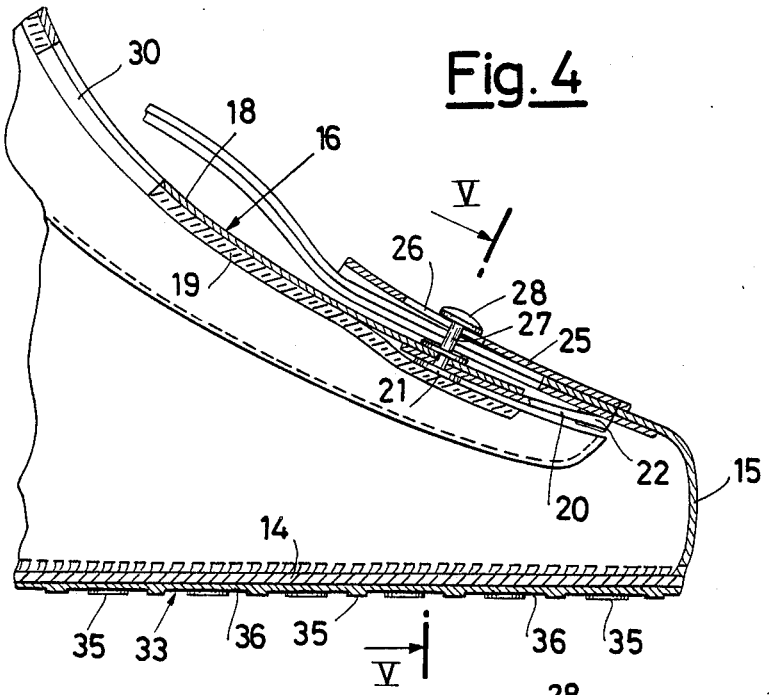
FIG. 4 is a detailed cross-section view of the part of the lining shoe to which the floating tongue is anchored.
Figure 5:
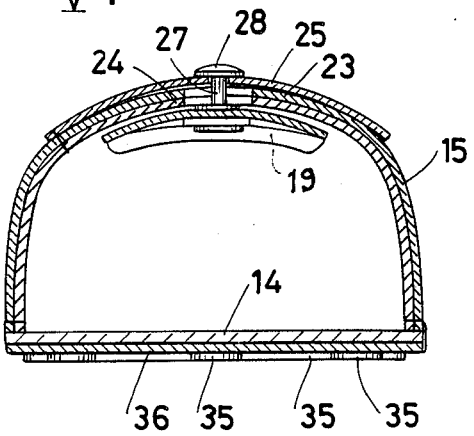
FIG. 5 is a cross-section view on the lines V—V of FIG. 4 looking in the direction of the arrows.

As shown in the cross-section views of FIGS. 4 and 5, the tongue 16 comprises an outer layer 18 of leather or like material and an inner padding 19.

Also the upper and the leg portion of the lining shoe 13 have like structure.

The fore end of the tongue 16 is anchored to the upper 15 near to the point of the lining shoe by means of an elastic band 20, having one end 21 fastened, by sewing or likewise, between the two layers forming the tongue and the opposite end 22 fastened, also preferably by sewing, to the inner surface of the upper.

The two edges 23 and 24 of the upper, near to the point, are connected by a crossing piece 25, preferably of real or synthetic or imitation leather or like material of high strength, in which a slot 26 is formed; in the slot 26 there is slidably housed the stem 27 of a floating anchoring pin, having an enlarged head 28 preventing it from coming out through the edges of the slot 26.

It is evident that in such a manner the tongue 16 may be displaced away from the point of the lining shoe towards which it is biased by the elastic force of the elastic band 20.

In the tongue 16, at the bending area corresponding to the foot neck and more specifically to the fore portion of articulation of the leg to the foot, an insert of elastic material 29 is provided, preferably with quilting sewings accommodating bending corresponding to the articulation movements of the foot with respect to the leg.

In the same area the tongue is provided with a relief opening 30, located at the portion of the foot at which the adducting tendon of the big toe comes to the surface, so as to avoid undue localized pressure acting onto the tendon.

It is evident that instead of the opening or relief 30, an inner reduction of the thickness of the tongue can be provided having enough depth to avoid the aforesaid localized pressure.

Figure 3:
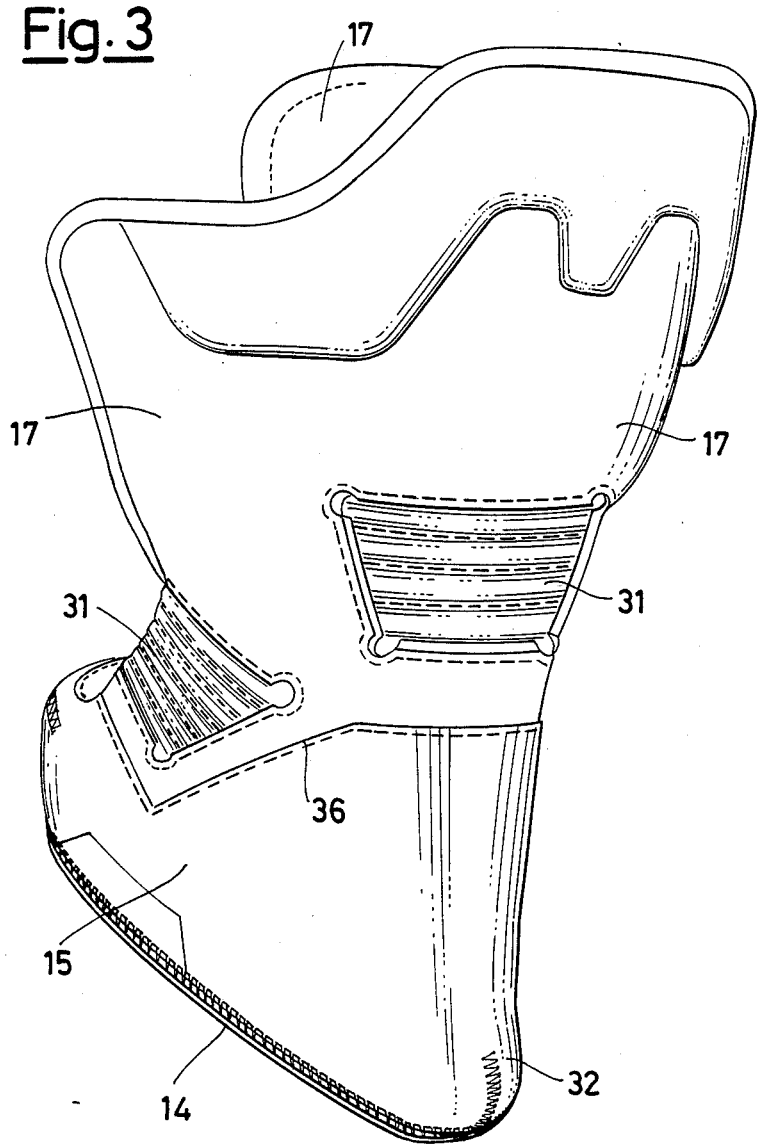
FIG. 3 is a rear view of the lining shoe of FIG. 2.

From FIG. 3 it is moreover clearly seen that at the junction between the upper and the leg portion of the shoe, one or more inserts 31 of elastic or elasticized material are provided, preferably having structure similar to that already described with respect to insert 29.

The function of the inserts 31 is that of making the leg portion of the lining shoe capable of being articulated with respect to the upper, whereby the latter, when the manoeuvers of the skier cause the boot to be under stress and consequently also the inner lining shoe, no deformation at the upper takes place and no undesirable stresses are applied to the foot enveloped by the lining shoe.

It is particularly to be observed that the inserts 31, in which obviously the more rigid outer layer 18 is lacking, are located so to avoid pressures and/or localized stresses onto the malleoli.

The broken line 37 in FIGS. 1 and 3 clearly indicates the contour of the part of the lining shoe which is more rigid and with respect to which the leg portion is deformed and bent, leaving the malleoli and generally the articulation between the leg and the foot free from stresses and constriction.

Figure 6:
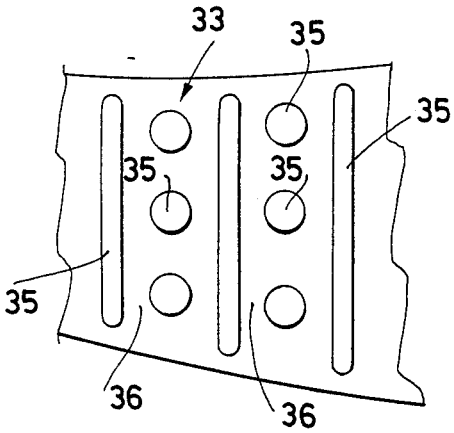
FIG. 6 is a partial enlarged scale view of the engraving pattern of the sole of the lining shoe.

Lastly, the sole of the lining shoe 14 has an outer engraved bottom 33, as shown in FIG. 6, with alternated embossings 35 and reliefs 36, the former being variously shaped so as to prevent the lining shoe from sliding with respect to the sole of the casing and thus with respect to the casing itself.

In addition, the lower part the lining shoe is connected to the sole in the manner clearly illustrated in FIG. 1 with the heel part 32 shaped so as to adhere as much as possible to the inner surface of the casing. According to a preferred variation, the sole is provided with a cross shaped hollow 34, within which, when necessary, a fitting reducing element, correspondingly shaped, can be inserted.

As is shown in FIG. 1, the shaped hollow 34 essentially corresponds to the metatarsal area of the foot whereby the introduction of a reducing element does act in a per se known manner to promote the fitting of a foot of smaller size, although slightly lower, (not more than half a size number), to the length of the lining shoe 13.

The lining shoe according to the present invention has been described with respect to a preferred embodiment but it is intended that modifications and variations which are conceptually and structurally equivalent to those shown are possible and foreseable and are within the scope of the present invention.

For instance the floating connection between the tongue and upper of the lining shoe can be achieved in a different manner whereby the anchoring allows for a mutual sliding motion in one or more directions.

What is claimed is:

1. An inner lining for boots, comprising a sole, an upper containing a fore opening, and provided at said fore opening with a tongue, and a leg portion by which said upper is completed, wherein said tongue is forwardly and rearwardly slidably connected to said upper.

2. An inner lining as claimed in claim 1, wherein said upper has a slot therein proximate to said tongue and said tongue is connected to said upper by means of a pin fastened to said tongue protruding through said slot.

3. An inner lining as claimed in claim 2, wherein said slot is formed in a crossing piece permanently connected to two facing edges of an open formed in the forward portion of said upper.

4. An inner lining as claimed in claim 1, wherein said tongue is anchored at its forwardly directed end to said upper by elastically deformable means.

5. An inner lining as claimed in claim 1, wherein the portion of said tongue corresponding to an articulation area of the foot, has an area of reduced thickness located proximate the adducting tendon of the big toe.

6. An inner lining as claimed in claim 5, wherein said area of reduced thickness is an opening of elongated shape.

7. An inner lining as claimed in claim 1, wherein the portion of said tongue corresponding to the articulation area or neck portion of the foot, comprises at least one elastically deformable insert whereby allowing easier bending with respect to the remaining part of said tongue along a predetermined bending line.

8. An inner lining as claimed in claim 1, wherein at least one elastically deformable insert is provided, (between said upper and said leg portion) for easier bending with respect to the remaining part of the material forming said upper and said leg portion, said insert being located so that the malleoli of the foot are substantially free from stresses and constrictions.

9. An inner lining as claimed in claim 7 or 8, wherein said insert is an elastic material.

10. An inner as claimed in claim 1, wherein said sole has anti-sliding engravure comprising relief areas and embossed areas, having alternatively the shape of bars and of circles crosswise aligned to each other, on the face thereof juxtaposed said boot.

11. A fore entry ski boot comprising an outer boot and an inner boot lining as claimed in claim 1.

* * * * *